US009869312B2

(12) United States Patent
Hoff

(10) Patent No.: US 9,869,312 B2
(45) Date of Patent: Jan. 16, 2018

(54) PISTON ROD FOR A PISTON COMPRESSOR, AND THE PISTON COMPRESSOR

(71) Applicant: NEUMAN & ESSER GMBH & CO. KG, Übach-Palenberg (DE)

(72) Inventor: Klaus Hubert Hoff, Aachen (DE)

(73) Assignee: NEUMAN & ESSER GMBH & CO. KG, Übach-Palenberg (DE)

( * ) Notice: Subject to any disclaimer, the term of this patent is extended or adjusted under 35 U.S.C. 154(b) by 418 days.

(21) Appl. No.: 14/605,241

(22) Filed: Jan. 26, 2015

(65) Prior Publication Data

US 2015/0211514 A1 Jul. 30, 2015

(30) Foreign Application Priority Data

Jan. 28, 2014 (DE) ..... 10 2014 201 473

(51) Int. Cl.

| | |
|---|---|
| ***F04B 39/00*** | (2006.01) |
| ***F04B 53/14*** | (2006.01) |
| ***F04B 39/06*** | (2006.01) |
| ***F04B 53/08*** | (2006.01) |

(52) U.S. Cl.

CPC ..... *F04B 53/144* (2013.01); *F04B 39/0022* (2013.01); *F04B 39/06* (2013.01); *F04B 53/08* (2013.01)

(58) Field of Classification Search

CPC ..... F04B 39/0022; F04B 39/06; F04B 39/08; F04B 53/08

USPC ..... 428/548, 558, 674

See application file for complete search history.

(56) References Cited

U.S. PATENT DOCUMENTS

| | | | | |
|---|---|---|---|---|
| 2,256,479 | A | 9/1941 | Hotzwarth | |
| 2013/0174728 | A1* | 7/2013 | Azevedo | F16J 7/00 92/187 |

FOREIGN PATENT DOCUMENTS

| | | | |
|---|---|---|---|
| CH | 134721 | A | 10/1929 |
| CH | 163967 | | 11/1933 |
| CN | 101418790 | A | 4/2009 |
| DE | 340086 | | 9/1920 |
| DE | 521491 | | 3/1931 |
| DE | 4209550 | A1 | 3/1992 |
| DE | 4441735 | A1 | 11/1994 |
| DE | 4405091 | A1 | 8/1995 |
| DE | 199 01 868 | B4 | 7/2007 |
| DE | 10 2006 049 759 | A1 | 4/2008 |
| DE | 10 2006 015 327 | B9 | 6/2010 |
| EP | 2 196 671 | A2 | 6/2010 |
| GB | 558 405 | A | 1/1944 |

(Continued)

OTHER PUBLICATIONS

MatWeb, Indium Corp. Indalloy 282, <http://www.matweb.com/search/datasheettext.aspx?matguid=3f9d5aa624ea454f81308048ab101817>.*

*Primary Examiner* — Michael Leslie
*Assistant Examiner* — Daniel Collins
(74) *Attorney, Agent, or Firm* — Hudak, Shunk & Farine Co. LPA

(57) ABSTRACT

A piston rod for piston compressors, wherein the piston rod has a base body with one end facing the piston, one end away from the piston, and at least one cavity. The cavity is filled with a solid, whose specific thermal conductivity is greater than that of the base body.

Furthermore, the invention concerns a piston compressor with a piston and a nonlubricated piston rod seal, wherein the piston is connected to the described piston rod.

20 Claims, 7 Drawing Sheets

(56) References Cited

FOREIGN PATENT DOCUMENTS

| | | | |
|---|---|---|---|
| GB | 771 247 | A | 3/1957 |
| JP | S63 215884 | A | 9/1988 |

* cited by examiner

PISTON ROD FOR A PISTON COMPRESSOR, AND THE PISTON COMPRESSOR

FIELD OF THE INVENTION

The present invention concerns a piston rod for piston compressors, having a base body with one end facing the piston, one end away from the piston, and at least one cavity. Moreover, the invention concerns a piston compressor with such a piston rod.

BACKGROUND OF THE INVENTION

Compressors and especially piston compressors are standard for the compressing of liquids or gases. In order to minimize the friction forces occurring between the moving parts of the compressors, compressors with oil lubrication are preferred. This oil lubrication has the task of providing a preferably hydrodynamic tribological contact between the sliding parts at the piston and guide rings and at the seals of the piston rod. Thanks to this tribological contact, very low rates of wear can be achieved for these sealing elements. Thus, standard lifetimes for lubricated machines of over 25000 hours with no significant wear can be achieved.

However, the oil lubrication comes with the risk of lubricant getting dissolved in the gases or liquids being sealed. Consequently, oil-lubricated compressors are unsuitable for sensitive media such as are used, for example, in the food industry or in the medical field.

To overcome this problem, piston compressors are being used increasingly with piston rod seals having no oil lubrication. This has been made possible by the development of sealing elements based on plastics.

Such sealing elements are described, for example, in DE 10 2006 015 327 B9. As the materials for piston rod sealing rings, plastics such as ballasted polymers have chiefly worked well. One often used polymer material is polytetrafluorethylene, for example. Solids such as amorphous carbon, graphite, glass fibers, metals, ceramics or solid lubricants are incorporated into the PTFE matrix. To increase the service life, usually several piston rod sealing rings, at least two, are arranged one behind the other in the axial direction and form a sealing element set, also known as a seal packing.

However, without the oil lubrication being present there are great changes in the tribological properties at the contact sites of the sliding parts. The hydrodynamic tribological contact becomes a tribochemical contact, which only results in good sliding performance and low rates of wear if a so-called transfer film is formed. Thanks to mechanical/physical forces between the sliding parts, structural changes occur in the surface of the sliding layer. These can be surface increases, decrease in particle size, formation of fresh surfaces, material abrasion, or even sometimes phase transformations, which are generally subsumed under the terms tribochemical contact or tribochemical process. However, this transfer film must be constantly renewed by additional tribochemical processes. Once a stationary renewal process has been established, low friction values and rates of wear are possible, but they are still substantially higher than those of the oil-lubricated sliding parts. Usually only around 8000 hours of operation can be achieved today in dry running conditions.

Due to the heightened friction values of the oil-free sliding part, the movement of the piston rod produces an increased output of frictional heat and thus an increased temperature at the contact sites.

However, extensive tribological studies have shown that this increased temperature in turn has a negative impact on the rates of wear of the sliding parts. In the worst case, this can result in premature failure of the compressor. Thus, an effective cooling of the sliding parts constitutes a major problem with dry lubrication.

A good cooling must be provided at the piston and guide rings, since the cylinder bushing and thus also the contact site between piston and cylinder bushing can be cooled, but not in the case of a piston rod seal.

The sealing rings of the piston rod seal are arranged in the so-called seal packing, also known as a packing gland. The chambers of the seal packings are usually filled with water. However, the cooling is not very effective, since a process gas present between the contact surface and the chambers prevents a good heat flow.

The bulk of the frictional heat produced is transported by thermal conduction along the piston rod from the region of the seal packing to a region at a distance from the seal packing. Here, the heat is ultimately taken away to the surroundings by the forced convection of the moving piston rod.

Yet conventional piston rods consist of steel materials, for example, and thus they have only slight thermal conductivities (steel: 15-58 W/(m·K)). This low thermal conductivity necessarily results in a large temperature gradient from the seal packing region (high temperature) to the region away from the seal packing (low temperature).

However, actively cooled piston rods are known from the prior art for an improved cooling of the piston rod.

Thus, for example, patent DE PS 340 086 discloses a piston rod for dual-action internal combustion engines, having a central borehole and a number of boreholes situated in proximity to the surface of the rod, so that the surface can be cooled by a coolant flowing through the boreholes.

But this device has the drawback that ports for the flowing coolant need to be provided at the piston rod. Furthermore, a circulating pump needs to be in constant operation, pumping the coolant through the piston rod. Both the ports and the pump increase the cost and maintenance expense of such cooled piston rods. Moreover, an unnoticed failure of the circulating pump results in an immediate rise in temperature of the piston rod and thus concomitant damage to it. Therefore, the functionality of the circulating pump must be constantly monitored, which likewise entails increased cost and time expense.

From DE 199 01 868 B4 there is known a piston rod having at least one coolant supply channel and at least one coolant drain channel. In addition, the piston rod has an axial blind borehole, and the at least one coolant supply channel and the at least one coolant drain channel are each arranged at the side of this blind borehole.

In addition to a cooling by the coolant channels, the blind borehole provides a weight reduction, so that during horizontal operation of the piston rod there should be reduced friction and thus less wear and tear.

But since the piston rod of DE 199 01 868 B4 is likewise cooled actively by means of coolant, the same drawbacks occur as were discussed in connection with the patent DE PS 340 086.

Liquid-cooled piston rods are also known from CH 163 967 and DE 521 491, which accomplish a temperature decrease for the piston rod, but likewise have the drawbacks of the patent DE PS 340 086.

SUMMARY OF THE INVENTION

Thus, the problem of the invention is to provide a piston rod for piston compressors that enables a good heat flow from the seal packing region and thus a reliable cooling of the piston rod seal and that can be produced more easily than the prior art, being more robust and less maintenance-demanding.

This problem is solved with a piston rod for piston compressors, wherein the piston rod comprises a base body with one end facing the piston and one end away from the piston, wherein the base body has at least one cavity, wherein the cavity is filled with a solid, whose specific thermal conductivity is greater than that of the base body; and a piston compressor with a piston and a piston cylinder, having a nonlubricated piston rod seal, wherein the piston is connected to a piston rod for piston compressors, wherein the piston rod comprises a base body with one end facing the piston and one end away from the piston, wherein the base body has at least one cavity, wherein the cavity is filled with a solid, whose specific thermal conductivity is greater than that of the base body. Further advantageous embodiments of the invention are proposed herein.

The piston rod of the invention for piston compressors has a base body with one end facing the piston, one end away from the piston, and at least one cavity. The piston rod is characterized in that the cavity is filled with a solid, whose specific thermal conductivity is greater than that of the base body.

By the end of the base body facing the piston is meant the end of the piston rod that has the least distance from the piston when installed in a compressor. The end away from the piston is the end opposite the end facing the piston, which can be connected by a connection segment especially to a crosshead.

The piston rod can have precisely one cavity, which is filled with solid. It is preferable to provide at least two cavities with solid.

As compared to piston rods made from a single material, the filling of the cavity in the base body with a solid having a higher specific thermal conductivity than the base body can carry away the thermal energy produced at the contact site between piston rod seal and piston rod much more quickly from the seal packing region. The temperature gradient forming within the piston rod between the end facing the piston and the end away from the piston is thus significantly reduced as compared to the prior art. Consequently, the end away from the piston has a higher temperature, so that the thermal energy can be surrendered more quickly and efficiently by convection to the surroundings. This enables a much more efficient cooling of the sealing rings of the piston rod seal as compared to piston rods made of a single material.

As compared to liquid-cooled piston rods, the piston rods filled with a solid have a greatly simplified design. No additional peripheral gear is needed, such as a pump. Costly port designs for the liquid transport are also eliminated. Thus, the piston rods filled with solid have greatly reduced manufacturing and maintenance expense and a concomitant cost reduction for the same good cooling of the piston rod.

The piston rod therefore has preferably no cavities for the carrying of liquids or installed parts such as pipes for the carrying of liquids. With the possible exception of air vent boreholes, neither does the piston rod preferably have any chambers, such as those filled with air, especially any chambers between the solid and the base body, since such chamber would impair the thermal conductivity of the overall piston rod.

If the piston rod has no installed parts and/or chambers in the cavity, the cavity filled with the solid is bounded off from the base body. This means that the solid lies against the base body, so that the thermal energy being taken away can be taken up and carried away directly by the solid. An except is, for example, closure means for the solid, which are arranged e.g. in the fill opening for the solid, and possibly also air vents which are provided at the cavity.

Thanks to the good cooling of the piston rod and thus also the contact surface, the formation of the transfer film by tribochemical processes between the sealing rings and the piston rod is favorably influenced. Thus, the rate of wear is decreased, which extends the lifetime of the sealing rings and thus that of the entire piston compressor.

In one advantageous embodiment of the piston rod, the specific thermal conductivity of the solid is >75 W/(m·K), especially preferably >100 W/(m·K) and in particular >200 W/(m·K).

The larger the thermal conductivity of the solid and/or the portion of the solid at the entire piston rod, the faster and more effective the transport of thermal energy from the piston rod region with higher temperature to the region with lower temperature. Thus, the piston rod seals can be more effectively cooled with large thermal conductivity. A significantly improved cooling is achieved as compared to piston rods consisting of only one homogeneous base body.

One advantageous embodiment calls for the solid to consist of at least one material chosen from the group of copper, copper alloy, aluminum, aluminum alloy, silver and silver alloy. The solid can consist of one of the mentioned materials or also from a mixture of the materials.

Copper, aluminum, silver, and their alloys are all characterized by high thermal conductivity. Thus, for example, copper has a thermal conductivity of 400 W/(m·K), aluminum one of 235 W/(m·K) and silver one of 430 W/(m·K). Thanks to the relatively high thermal conductivity and the favorable material price, copper or a copper alloy is preferred in particular as the solid.

Besides good thermal conductivity, copper, aluminum or silver and their alloys are also distinguished by good workability. Thus, the base body can be filled with the particular materials quickly, effectively, and cheaply.

In a likewise advantageous embodiment of the piston rod, the base body has at least one cavity which is filled with the solid, preferably completely filled. The base body can be manufactured in advance, independently of the solid, and then be filled with the desired solid. The thermal properties can thus be adapted to different requirements of the piston rod.

For the filling of the cavity, the solid is preferably melted down and poured in the liquid state into the cavity. Alternatively, the solid can also be pressed directly into the cavity. Furthermore, a cavity is advantageous that extends from the end facing the piston at least partly to the end away from the piston of the base body.

When a piston rod is installed in a piston compressor the end facing the piston lies closer to the piston rod seal than the end away from the piston. It is therefore advantageous for the cavity with the solid to also start at this end of the piston rod and to extend from there in the direction of the end away from the piston, while the cavity need not extend entirely to this end. The thermal energy can be carried further away from the seal packing region as the length of this cavity is greater, which in turn improves the cooling process. It is therefore advantageous when $L_H \geq 0.3 \cdot L_G$, especially $L_H \geq 0.5 \cdot L_G$, where $L_H$ is the length of the cavity and $L_G$ is the length of the base body. Preferably, $L_H \geq 0.6 \cdot L_G$ and especially preferably $L_H \geq 0.75 \cdot L_G$.

Preferably, the cavity is filled with the solid over the entire length $L_H$. In this case, $L_H = L_F$, where $L_F$ is the length of the cavity segment filled with solid. Preferably, $L_F \geq 0.3\ L_G$, especially $L_F \geq 0.5\ L_G$. Preferably $L_F \geq 0.6\ L_G$ and especially preferably $L_F \geq 0.75\ L_G$.

Preferably, the length $L_F$ of the cavity segment filled with solid extends for at least the length of the contact segment of the piston rod which is in contact with the piston rod seal during the reciprocating movement of the piston rod.

Preferably, the volume of the cavity and thus the volume of the solid when the cavity is entirely full is at least 25%, especially preferably at least 50% of the volume of the entire piston rod. Preferably the volume of the solid is at least 10%, preferably at least 25%, especially at least 50% of the volume of the entire piston rod The more solid is contained in the base body, the more quickly the heat is carried away.

The cavity in another advantageous embodiment is a cylindrical cavity, whose radius $R_H$ is preferably: $R_H \geq 0.5 \cdot R_G$, where $R_G$ is the radius of the base body of the piston rod. This ratio of the radii holds for a base body with circular cross section. Preferably the cylindrical cavity extends or the cylindrical cavities extend parallel to the lengthwise axis of the piston rod. Other cross sections of cavity and base body are likewise possible.

Piston rods for piston compressors generally have a round cross section. This cross section enables an optimal distribution of forces and stresses inside the piston rod. A cylindrical cavity inside this piston rod has no major influence on these load distributions, so that the mechanical stability of the piston rod is only slightly affected by the cavity. Furthermore, a cylindrical cavity in the piston rod is easy to make, for example, by a borehole. One advantageous embodiment calls for the cavity to be a blind borehole.

The blind borehole is preferably installed in the piston rod from the end facing the piston. The borehole ends prior to the end away from the piston, so that only one entrance opening is made in the cavity, but no exit opening. A cavity which is formed by a blind borehole can be produced quickly and cheaply, and on the other hand this cavity can also be easily filled with the solid.

The cavity of the piston rod in one likewise advantageous embodiment can be closed at the end facing the piston by means of a connecting part for the piston. To enable this closure, a thread is cut, for example, in or on the end facing the piston, so that the connecting part can be screwed into or onto the piston rod. This embodiment enables a quick mounting of the piston rod on the piston. Furthermore, the closure of the cavity protects the solid from external environmental influences. In particular, an oxidation favored by the high temperatures is prevented. This might have negative impact on, for example, the thermal conductivity of the solid.

When the base body of the piston rod has a cavity, for example in the form of a blind borehole, this cavity is preferably provided in the longitudinal axis of the piston rod.

If the base body of the piston rod has two or more cavities, each of them filled with a solid, these cavities can be filled with the same or with different solids. The cavities preferably extend parallel to each other and/or parallel to the lengthwise axis of the piston rod through the base body. The cavities are preferably arranged on a circle about the lengthwise axis of the base body, preferably with a uniform distribution.

Two or more cavities within the base body have the advantage that they can be arranged closer to the surface of the piston rod, without negatively influencing the stability of the piston rod. The closer the solid with its high thermal conductivity is arranged to the surface of the piston rod, the more effectively the thermal energy can be carried away from the higher temperature regions. The cavities can be cylindrical in configuration and be arranged alongside each other. It is also possible to provide annular cavities, which are arranged concentrically. Concentric cavities can also be combined with a cylindrical cavity in the lengthwise axis of the piston rod.

In another advantageous embodiment of the piston rod, the base body has at least one air vent. This at least one air vent is preferably configured as an air vent borehole and extends preferably from the end away from the piston of the cavity through the entire base body of the piston rod to the outside. The air vent borehole can be arranged parallel or perpendicular to the cavity and/or to the lengthwise axis of the piston rod. Thanks to this at least one air vent, the cavity is in communication with the surroundings of the piston rod, so that the air located in the cavity can escape during the filling process of the solid. This facilitates the filling process.

If the piston rod has two or more cavities, an air vent is preferably arranged at each cavity.

An air vent offers the further advantage of greatly reducing the danger of air inclusions during the process of filling the at least one cavity with the solid. Consequently, the filling process of the cavity is simplified, which in turn enables a faster and more economical fabrication of the piston rod.

Besides a piston rod, the invention also concerns a piston compressor with a piston and a piston cylinder, having a nonlubricated piston rod seal. This piston compressor is characterized in that the piston is connected to a piston rod that has a base body with one end facing the piston and one end away from the piston, wherein the base body has at least one cavity, wherein the cavity is filled with a solid, whose specific thermal conductivity is greater than that of the base body.

When the piston compressor is in operation, the piston rod seal thanks to the reciprocating movement of the piston rod makes contact with a contact segment on the piston rod. Preferably a cavity segment filled with solid extends at least across the contact segment.

BRIEF DESCRIPTION OF THE DRAWINGS

Sample embodiments of the invention will now be explained more closely with the aid of the drawings. There are shown.

DETAILED DESCRIPTION OF THE INVENTION

Figure 1:
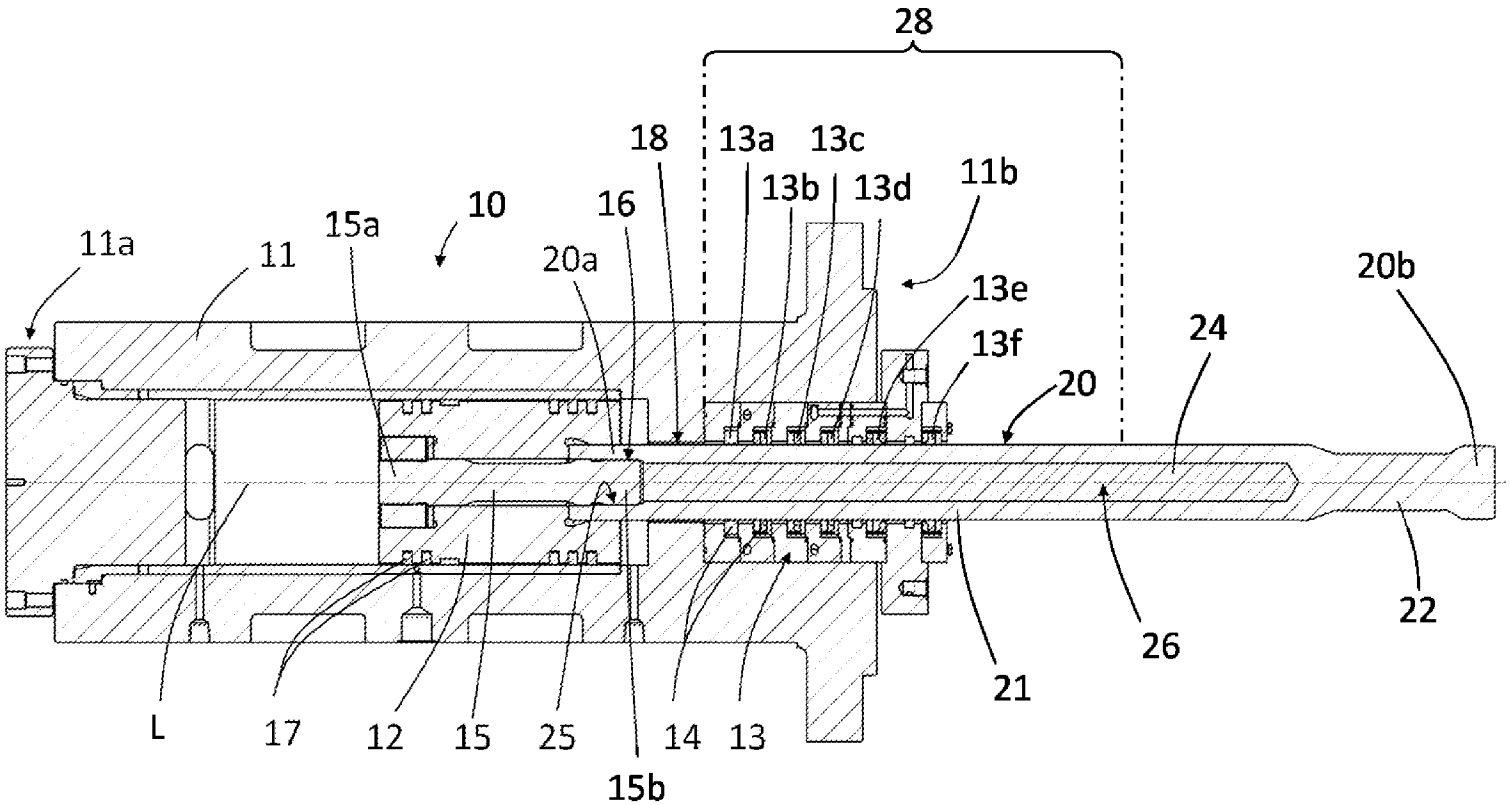
FIG. 1 is a schematic representation of a piston compressor in sectional view with one cavity in the base body of the piston rod.

FIG. 1 shows a cross sectional representation of a piston compressor 10. The piston compressor 10 has a cylinder 11, which is closed at a first end 11*a* and at the second end 11*b* has an opening 18 for the passage of a piston rod 20.

Inside the cylinder 11 is arranged a piston 12 able to move in the direction of the longitudinal axis L of the compressor 10. The piston 12 has piston seals 17 and a connecting part 15, which joins the piston 12 to the piston rod 20. The connecting part 15 extends through the piston 12 and is connected by a first end 15*a* to the piston 12. By a second end 15*b* the connecting part 15 is fastened to the piston rod 20.

The piston rod 20 has an end 20*a* facing the piston and an end 20*b* away from the piston, while the end 20*a* facing the piston is joined to the connecting part 15. The piston rod 20 has a base body 21 made of a steel material with a connection segment 22, on which a cross head (not shown) can be mounted. The base body 21 is partly filled with a solid 26 that has a higher thermal conductivity than the material of the base body 21. For this, the piston rod 20 has a cavity 24, which is fashioned as a blind borehole 23 and which is filled with the solid 26.

The base body 21 of the piston rod 20 extends through a piston rod seal 13 arranged at the second end 11*b* of the cylinder 11, having several sealing chambers 13*a-f* with seals 14, for example consisting of PTFE. This is a nonlubricated piston rod seal 13, at which the aforementioned transfer film is formed during operation between the sealing rings 14 and the base body 21 of the piston rod 20.

In the representation shown in FIG. 1, the solid fill extends from the end 20*a* facing the piston to the connection segment 22, so that not only the contact segment 28 of the piston rod 20, which makes contact with the piston rod seal 13 during the reciprocating motion of the piston rod, but also the exposed region of the piston rod 20 between the contact segment 28 and the connection segment 22 is filled with solid, such as copper or a copper alloy. The heat generated by friction in the contact segment 28 is easily carried away by means of the solid from the contact segment 28 into the exposed region, where the heat is surrendered to the surroundings.

Figure 2A:
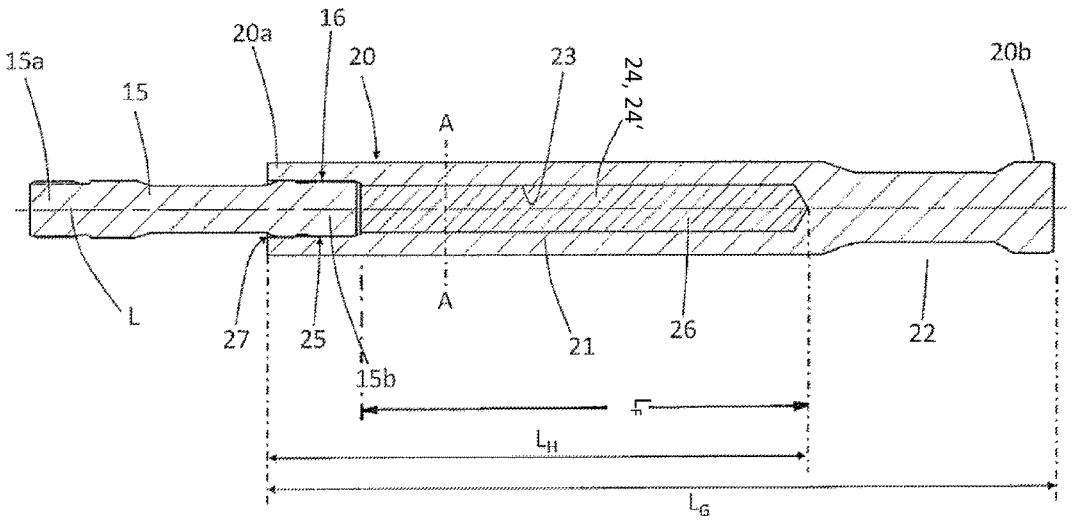
FIG. 2*a* is a schematic representation of the piston rod with one cavity in sectional view.

In FIG. 2*a* the piston rod 20 obtained in FIG. 1 having a length $L_G$ is shown in enlarged cross section with the connecting part 15.

In the base body of the piston rod 20 is situated the blind borehole 23, which lies in the longitudinal axis L of the piston rod 20 and which has been introduced from the end 20*a* facing the piston into the base body 21 of the piston rod 20. The blind borehole 23 has a length $L_H$ and extends up to and before the connection segment 22. $L_F$ designates the length of the cavity segment 24' filled with solid 26. Both $L_H$ and $L_F$ are $\geq 0.5 \cdot L_G$. The length $L_F$ of the cavity segment 24' filled with solid extends on either side beyond the contact segment 28 indicated in FIG. 1. Therefore, $L_F$ extends at least over the length of the contact segment 28. It is also possible for the blind borehole 23 to extend into the connection segment 22.

Through the cavity opening 27 located at the end 20*a* facing the piston, the solid 26 is introduced into the cavity 24 formed by the blind borehole 23. After the filling with the solid 26, the cavity opening 27 is closed by means of the connecting part 15. The cavity 24 is filled completely with the solid 26, except for the region where the connecting part 15 is arranged. In order to fasten the connecting part 15, there is provided an internal thread 25 on the inside of the base body 21 of the piston rod 20 at its end 20*a* facing the piston and an external thread 16 corresponding to the internal thread 25 on the outside of the second end 15*b* of the connecting part 15. Thanks to this screw connection, the piston rod 20 and the connecting part 15 can be removably joined together.

Figure 2B:
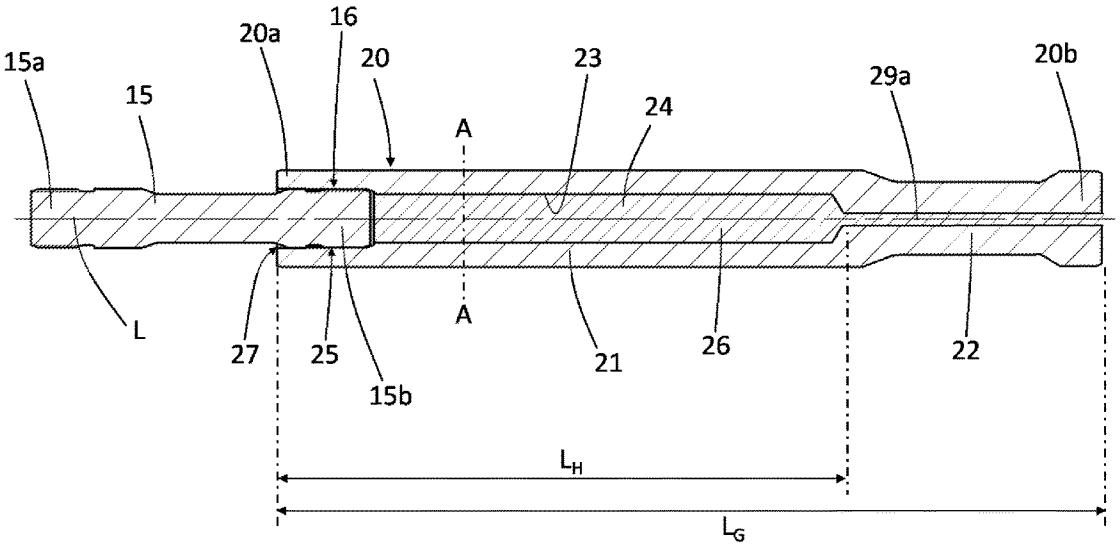
FIG. 2*b* is a schematic representation of the piston rod in sectional view with one cavity and air vents.

FIG. 2*b* shows a piston rod 20 which has an air vent 29*a* in addition to the cavity 24 of the piston rod 20 already described in FIG. 2*a*. This air vent 29*a* is configured as an air vent borehole and it facilitates the filling of the cavity 24 with the solid 26, since the excess air can escape through this air vent borehole 29*a* from the cavity 24. Preferably the air vent borehole 29*a* extends parallel to the longitudinal axis L and in particular to the longitudinal axis L from the end of the cavity 24 to the end 20*b* away from the piston of the piston rod 20. In the representation shown here, the solid 26 is also present in the air vent borehole.

Figure 3:
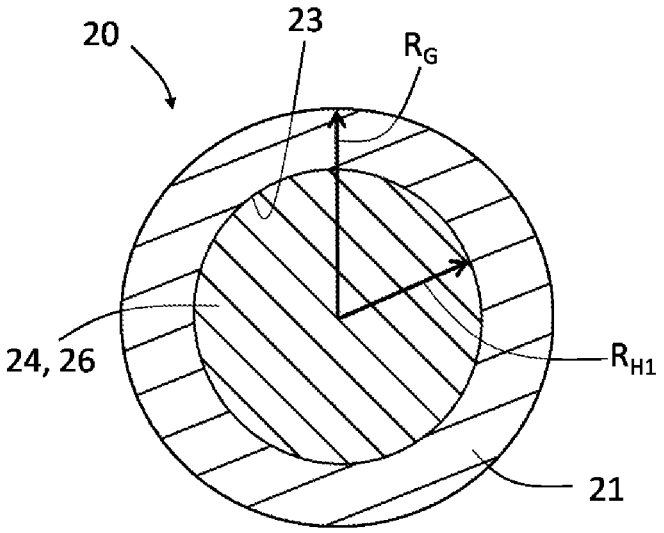
FIG. 3 is a cross sectional representation of the piston rod with one cavity.

FIG. 3 shows a cross section along line A-A through the piston rod 20 depicted in FIG. 2*a*, having a cylindrical base body 21. $R_{H1}$ designates the radius of the blind borehole 23 and thus the radius of the cavity 24. $R_G$ is the radius of the cylindrical base body 21, while $R_{H1} > 0.5 \cdot R_G$.

The base body 21 can also have other cross sections, such as rectangular or oval. Several blind boreholes 23 can also be made in the base body 21 and be filled with solid 26.

Figure 4:
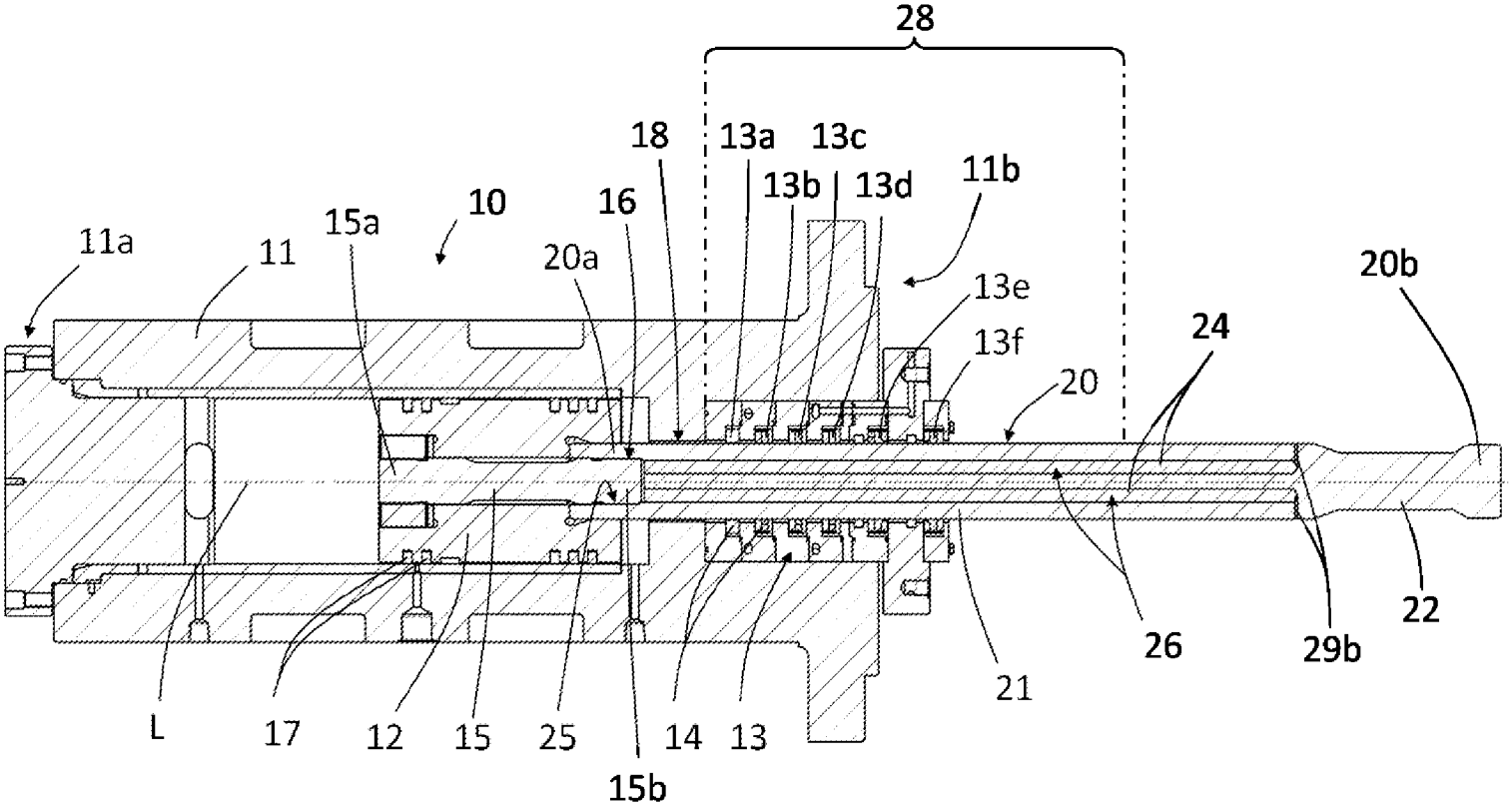
FIG. 4 is a schematic representation of a piston compressor in sectional view with two cavities in the base body of the piston rod.

FIG. 4 like FIG. 1 shows a piston compressor 10. In contrast with FIG. 1, the piston rod 20 of FIG. 4 has two cavities 24, each of which is filled with a solid 26. Furthermore, an air vent 29*b* is arranged at each end of the cavity 24 away from the piston. These air vents 29*b* run preferably perpendicular to the longitudinal axis L through the base body 21 of the piston rod 20.

All other features are identical to FIG. 1, so that reference is made here to the description for FIG. 1.

Figure 5:
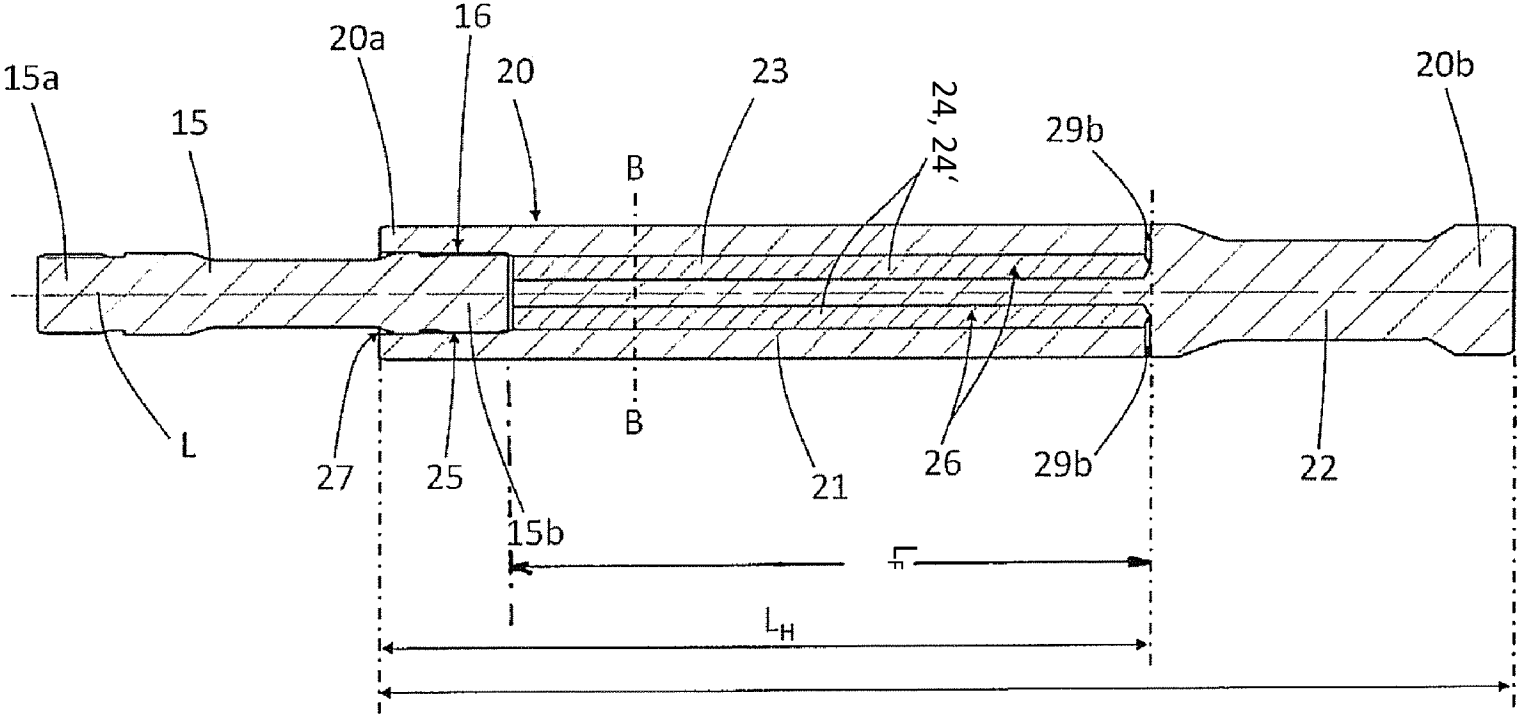
FIG. 5 is a schematic representation of the piston rod with two cavities in sectional view.

FIG. 5 shows the piston rod 20 having a length $L_G$ with the connecting part 15 in sectional view, similar to FIG. 2.

In contrast with the piston rod 20 of FIG. 2, there are two cavities 24 in the base body of the piston rod 20 of FIG. 5 in the form of blind boreholes 23, which are introduced from the end 20*a* facing the piston into the base body 21 of the piston rod 20. The blind boreholes 23 each have a length $L_H$ and extend parallel to each other up to and before the connection segment 22. The cavity segment 24' filled with solid of the cavity 24 has a length $L_F$. It is also possible for the blind boreholes 23 to extend into the connection segment 22. Furthermore, the lengths of the two blind boreholes 23 can be the same or different. At least one air vent 29*b* in the form of an air vent borehole is arranged at each end away from the piston of the cavities 24. As has already been explained in connection with FIG. 4, these extend preferably from cavity 24 perpendicular to the longitudinal axis L through the entire base body 21 of the piston rod 20. The air vent boreholes do not contain any solid 26.

Through the cavity opening 27 situated at the end 20*a* facing the piston, the solid 26 is introduced into the cavities 24 formed by the blind boreholes 23. The excess air can escape from the cavities 24 through the air vents 29*b*. Each cavity 24 can be filled with the same or also with different solid 26. After the filling with solid 26, the cavity opening 27 is closed by means of the connecting part 15. For this, there is likewise provided an internal thread 25 on the inside of the base body 21 of the piston rod 20 at its end 20*a* facing the piston and an external thread 16 corresponding to the internal thread 25 on the outside of the second end 15*b* of the connecting part 15. Thanks to this screw connection, the piston rod 20 and the connecting part 15 can be removably joined together.

Figure 6:
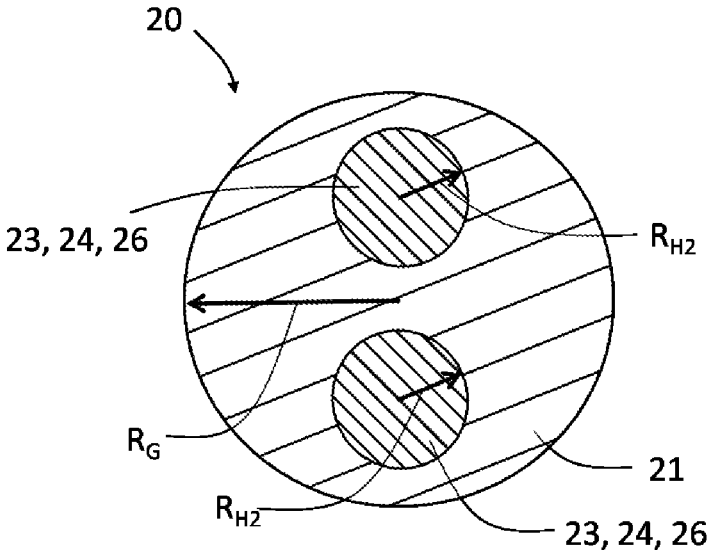
FIG. 6 is a cross sectional representation of the piston rod with two cavities.

FIG. 6 shows a cross section along line B-B through the piston rod 20 shown in FIG. 5, having a cylindrical base body 21. The two cavities 24 are arranged out of center and close to the surface of the base body 21. $R_{H2}$ designates the radius of the cavities 24 and thus the radius of the blind boreholes 23. This radius can be the same for each blind borehole 23 or different. $R_G$ is the radius of the cylindrical base body 21, while in the event that the radii $R_{H2}$ of the blind boreholes 23 are the same we have: $2 \cdot R_{H2} > 0.5 \cdot R_G$.

But if the blind boreholes 23 have different radii $R_{H2}$, then preferably the sum of the radii is $R_{H2} > 0.5\ R_G$.

The base body 21 can also have other cross sections, such as rectangular or oval.

LIST OF REFERENCE SYMBOLS

10 Piston compressor
11*a* First cylinder end
11*b* Second cylinder end
11 Cylinder of piston compressor
12 Piston
13 Piston rod seal
13*a*-13*f* Sealing chamber
14 Sealing ring
15 Connecting part
15*a* First connecting part end
15*b* Second connecting part end
16 External thread of connecting part
17 Piston seal
18 Opening
20 Piston rod
20*a* End facing piston
20*b* End away from piston
21 Base body of piston rod
22 Connection segment
23 Blind borehole
24 Cavity
24' cavity segment filled with solid
25 Internal thread
26 Solid
27 Cavity opening
28 Contact segment
29*a* Air vent
29*b* Air vent
L Longitudinal axis
A-A Cross section plane through the piston rod
B-B Cross section plane through the piston rod
$L_G$ Length of base body
$L_H$ Length of cavity
$L_F$ Length of the cavity segment filled with solid
$R_G$ Radius of base body
$R_{H1}$ Radius of cavity
$R_{H2}$ Radius of cavity

What is claimed is:

1. A piston rod for piston compressors, wherein the piston rod comprises: a base body with one end facing a piston and one end away from the piston, wherein the base body has at least one cavity, wherein the cavity is filled with a solid, whose specific thermal conductivity is greater than that of the base body, and wherein the piston rod has no cavities for carrying liquids.

2. The piston rod according to claim 1, wherein the specific thermal conductivity of the solid is >75 W/(m·K).

3. The piston rod according to claim 1, wherein the solid includes one or more of copper, copper alloy, aluminum, aluminum alloy, silver and silver alloy.

4. The piston rod according to claim 1, wherein the cavity filled with solid extends from the end facing the piston at least partly to the end away from the piston of the base body.

5. The piston rod according to claim 1, wherein the cavity filled with solid extends from the end facing the piston with a length $L_H$ in the direction of the end away from the piston, while: $L_H \geq 0.5 \cdot L_G$, where $L_G$ is the length of the base body.

6. The piston rod according to claim 1, wherein a volume of the cavity is at least 25% of an entire volume of the piston rod.

7. The piston rod according to claim 1, wherein a volume of the solid is at least 10% of a total volume of the piston rod.

8. The piston rod according to claim 1, wherein the cavity is a blind borehole.

9. The piston rod according to claim 1, wherein the cavity can be closed at the end facing the piston by a connecting part for a piston.

10. The piston rod according to claim 1, wherein the base body has at least one air vent.

11. A piston compressor with a piston and a piston cylinder, having a nonlubricated piston rod seal, wherein the piston is connected to a piston rod according to claim 1.

12. The piston compressor according to claim 11, further including a piston rod seal, which makes contact with a contact segment on the piston rod during operation of the piston compressor, wherein a cavity segment filled with solid of the cavity extends at least across the contact segment.

13. The piston compressor according to claim 12, wherein the solid includes one or more of copper, copper alloy, aluminum, aluminum alloy, silver and silver alloy.

14. The piston compressor according to claim 13, wherein the cavity filled with solid extends from the end facing the piston at least partly to the end away from the piston of the base body.

15. The piston compressor according to claim 14, wherein the cavity filled with solid extends from the end facing the piston with a length $L_H$ in the direction of the end away from the piston, while: $L_H \geq 0.5 \cdot L_G$, where $L_G$ is the length of the base body.

16. The piston compressor according to claim 15, wherein a volume of the cavity is at least 25% of an entire volume of the piston rod.

17. The piston compressor according to claim 16, wherein the volume of the solid is at least 10% of a total volume of the piston rod.

18. The piston compressor according to claim 17, wherein the cavity is a blind borehole.

19. The piston compressor according to claim 18, wherein the cavity can be closed at the end facing the piston by means of a connecting part for a piston.

20. The piston compressor according to claim 19, wherein the base body has at least one air vent.

* * * * *